US011493260B1

(12) United States Patent
Carden et al.

(10) Patent No.: US 11,493,260 B1
(45) Date of Patent: Nov. 8, 2022

(54) FREEZERS AND OPERATING METHODS USING ADAPTIVE DEFROST

(71) Applicant: Thermo Fisher Scientific (Asheville) LLC, Asheville, NC (US)

(72) Inventors: Michael Scot Carden, Marshall, NC (US); Todd Swift, Weaverville, NC (US); Martin Peter Winik, Weaverville, NC (US); Raghu Ram Muddasani, Asheville, NC (US); Zhirong Yang, Arden, NC (US)

(73) Assignee: Thermo Fisher Scientific (Asheville) LLC, Asheville, NC (US)

( * ) Notice: Subject to any disclaimer, the term of this patent is extended or adjusted under 35 U.S.C. 154(b) by 83 days.

(21) Appl. No.: 16/427,759

(22) Filed: May 31, 2019

Related U.S. Application Data

(60) Provisional application No. 62/678,741, filed on May 31, 2018.

(51) Int. Cl.
*F25D 21/00* (2006.01)
*F25B 47/02* (2006.01)
*F25D 21/02* (2006.01)

(52) U.S. Cl.
CPC ..... *F25D 21/006* (2013.01); *F25B 47/022* (2013.01); *F25D 21/004* (2013.01); (Continued)

(58) Field of Classification Search
CPC ..... F25D 21/006; F25D 21/008; F25D 21/02; F25D 21/004; F25D 2700/10; F25D 2700/14; F25D 2700/02; F25B 47/022
See application file for complete search history.

(56) References Cited

U.S. PATENT DOCUMENTS 4,528,821 A * 7/1985 Tershak ..... F25D 21/006 62/153
4,882,908 A * 11/1989 White ..... F25B 13/00 62/155

(Continued)

FOREIGN PATENT DOCUMENTS

CN 106605112 A * 4/2017
JP H03113252 A * 5/1991

(Continued)

OTHER PUBLICATIONS

Hamada et al., Defrosting Device, Jan. 20, 1995, JPH0719710A, Whole Document (Year: 1995).*

(Continued)

*Primary Examiner* — Larry L Furdge
(74) *Attorney, Agent, or Firm* — Wood Herron & Evans LLP

(57) ABSTRACT

A freezer and method of operating a freezer are provided with an adaptive defrost cycle. The freezer includes a controller that operates the freezer to: provide cooling to a cabinet via an evaporator during periodic operational cycles, monitor a time elapsed since a most recent defrost cycle, determine whether the time elapsed is greater than a current defrost interval, and perform a defrost cycle if so. The controller varies the current defrost interval between a first, larger time value and a second, smaller time value based on a plurality of trigger signals in response to various operating characteristics of the freezer monitored by sensors. After each defrost cycle is completed, the current defrost interval is reset to the first, larger time value.

21 Claims, 8 Drawing Sheets

(52) U.S. Cl.
CPC ..... *F25D 21/008* (2013.01); *F25D 21/02* (2013.01); *F25D 2700/02* (2013.01); *F25D 2700/10* (2013.01); *F25D 2700/14* (2013.01)

(56) References Cited

U.S. PATENT DOCUMENTS 5,440,893 A * 8/1995 Davis ..... F25D 21/006 62/155
5,564,286 A * 10/1996 Suse ..... F25D 21/006 62/153
5,651,261 A 7/1997 Nakajima et al.
5,689,964 A 11/1997 Kawakita et al.
5,970,727 A 10/1999 Hiraoka et al.
6,032,471 A 3/2000 Choi
6,058,724 A * 5/2000 Park ..... F25D 21/002 62/156
6,112,534 A 9/2000 Taras et al.
6,205,792 B1 3/2001 Anderson
6,250,090 B1 6/2001 Mei et al.
6,260,365 B1 7/2001 Davis et al.
6,263,686 B1 7/2001 Burkhart
6,415,616 B1 7/2002 Kim
6,467,282 B1 10/2002 French et al.
6,497,108 B2 12/2002 Collins et al.
6,523,358 B2 2/2003 Collins
6,601,396 B2 8/2003 Bair, III et al.
6,606,870 B2 8/2003 Holmes et al.
6,609,388 B1 8/2003 Hanson
6,622,503 B1 9/2003 Bennett et al.
6,631,620 B2 10/2003 Gray et al.
6,662,578 B2 12/2003 Pham et al.
6,694,753 B1 2/2004 Lanz et al.
6,694,754 B1 2/2004 Schenk et al.
6,694,755 B2 2/2004 Collins
6,715,304 B1 4/2004 Wycoff
6,739,146 B1 5/2004 Davis et al.
6,772,597 B1 8/2004 Zentner et al.
6,779,352 B2 8/2004 Jeong
6,817,195 B2 11/2004 Rafalovich et al.
6,837,060 B2 1/2005 Collins
6,851,270 B2 2/2005 Denvir
6,964,172 B2 11/2005 Dudley et al.
6,981,385 B2 1/2006 Arshansky et al.
7,089,752 B2 8/2006 Jeong et al.
7,228,692 B2 6/2007 Concha et al.
7,275,376 B2 10/2007 Swofford et al.
7,716,936 B2 5/2010 Bailey et al.
7,757,505 B2 7/2010 Sunderland
7,895,845 B2 3/2011 Every et al.
7,913,500 B2 * 3/2011 Lim ..... F25D 21/006 62/155
7,921,660 B2 4/2011 Brody
8,341,970 B2 1/2013 Ouchi et al.
8,417,386 B2 4/2013 Douglas et al.
8,511,102 B2 8/2013 Feng et al.
8,601,831 B2 12/2013 Fotiadis et al.
8,689,573 B2 4/2014 Zangari et al.
8,739,563 B2 6/2014 Coussey et al.
9,032,751 B2 5/2015 Lacey et al.
9,068,771 B2 6/2015 Shah
9,086,233 B2 7/2015 Chun et al.
9,127,875 B2 9/2015 Hall
9,188,381 B2 11/2015 Derosier
9,243,834 B2 1/2016 Kim et al.
9,341,405 B2 5/2016 Qu et al.
9,410,727 B1 8/2016 Boyko
9,464,840 B2 10/2016 Boyko
9,551,523 B2 1/2017 Dauria et al.
9,574,816 B2 2/2017 Hamada et al.
9,605,889 B2 3/2017 Qu et al.
9,605,890 B2 3/2017 Micka et al.
9,638,455 B2 5/2017 Kim et al.
9,664,425 B2 5/2017 Tsai
9,772,138 B2 9/2017 Hagiwara et al.
9,803,911 B2 10/2017 Qu et al.
9,920,974 B2 3/2018 Langenberg et al.
9,933,200 B2 4/2018 Qu et al.
9,964,345 B2 5/2018 Vie et al.
9,976,792 B2 5/2018 Besore
9,995,515 B2 6/2018 Liu
10,001,317 B2 6/2018 Takenaka et al.
10,018,400 B2 7/2018 Qu et al.
10,041,721 B2 8/2018 Qu et al.
2006/0242973 A1 11/2006 Manettas et al.
2009/0044557 A1 2/2009 Weber et al.
2009/0049849 A1 2/2009 Kim
2010/0089081 A1 4/2010 Fontecchio et al.
2011/0289945 A1 12/2011 Choi et al.
2012/0031127 A1 2/2012 Kim
2013/0086929 A1 4/2013 Senf, Jr.
2014/0352335 A1 * 12/2014 Anderson ..... F25D 21/008 62/80
2015/0184920 A1 7/2015 Vie et al.
2015/0184922 A1 7/2015 Vie et al.
2015/0184924 A1 7/2015 Vie et al.
2015/0184926 A1 7/2015 Yun
2016/0178259 A1 6/2016 Kimura et al.
2016/0238301 A1 8/2016 Denton
2017/0176072 A1 6/2017 Gokhale et al.
2017/0211871 A1 7/2017 Herrera et al.
2017/0276422 A1 * 9/2017 Chamoun ..... F25B 30/02
2017/0292769 A1 10/2017 Laurentius et al.
2017/0292770 A1 10/2017 Fowler et al.
2017/0370627 A1 12/2017 Takenaka et al.
2018/0017300 A1 1/2018 Shockley et al.
2018/0031289 A1 2/2018 Hern et al.
2018/0051921 A1 2/2018 Ho et al.
2018/0142929 A1 5/2018 Prabhakaran

FOREIGN PATENT DOCUMENTS

JP H0719710 A * 1/1995
JP H0828930 A * 2/1996
JP H10205979 A * 8/1998
JP 2009014261 A * 1/2009

OTHER PUBLICATIONS

Tanaka, Absorption Type Refrigerator, Aug. 4, 1998, JPH10205979A, Whole Document (Year: 1998).*
Kuwamura, Air Conditioner, Feb. 2, 1996, JPH0828930A, Whole Document (Year: 1996).*
Kawanami et al., Refrigerator, Apr. 26, 2017, CN106605112A, Whole Document (Year: 2017).*
Hamachi, Operation Control Device for Refrigerating Plant, May 14, 1991, JPH03113252A, Whole Document (Year: 1991).*
Aoki et al., Refrigerator, Jan. 22, 2009, JP2009014261A, Whole Document (Year: 2009).*

* cited by examiner

FREEZERS AND OPERATING METHODS USING ADAPTIVE DEFROST

CROSS REFERENCE TO RELATED APPLICATION

This application claims the benefit of U.S. Provisional Patent Application Ser. No. 62/678,741, filed on May 31, 2018, the disclosure of which is hereby incorporated by reference in its entirety.

TECHNICAL FIELD

The present invention relates generally to laboratory freezers and, more particularly, relates to adaptive defrost systems and methods for providing variable time between evaporator coil auto-defrost cycles for laboratory freezers.

BACKGROUND

Laboratory freezers require occasional defrost cycles to remove frost which inevitably accumulates on the evaporator coils of the freezer's refrigeration circuit during normal cooling operation. Conventional freezers may be configured with a default fixed time interval between auto-defrost cycles, which are typically carried out by dedicated heaters external to the evaporator coils and/or by compressor hot gas circulation through the evaporator coils. For example, a freezer may be configured with a fixed 12-hour time interval between defrost cycles. Thus, the freezer may perform a normal cooling operation or cycle for 12 hours (of elapsed or clock time) and then perform a defrost cycle. After the defrost cycle concludes, the freezer may resume normal operation for another 12 hours and then again switch to a defrost cycle, and so forth. Such a configuration does not account for the possibility that, under a variety of conditions, the fixed time interval may be insufficient for adequately removing frost from the evaporator coils. As a result, undesirable frost buildup may occur during some cooling cycles and may inhibit the cooling capabilities of the freezer, thereby leading to degradation and/or spoilage of the cargo of the freezer.

Previous attempts to address these problems have included providing freezers with adaptive defrost techniques, wherein the time interval between defrost cycles typically starts at a minimum predetermined interval and is then incrementally extended toward a maximum predetermined interval until a reset to the minimum predetermined interval is required based on a single input, such as the time that a defrost heater is operated or the temperature sensed by an evaporator coil probe. However, such techniques can in many situations either (a) result in undesirably high energy usage, (b) fail to account for a sufficient variety of conditions which may cause the incrementally increasing interval to be insufficient for adequately removing frost from the evaporator coils such that there remains a high risk of inadequate defrosting, and/or (c) lead to an undesirably large increase in compartment temperature due to the large number of individual defrost cycles performed. Furthermore, the use of incremental changes to defrost intervals adds significant complexity to the controls needed for operating the freezer, thereby increasing cost and potential failure modes of these conventional designs.

Thus, it would be desirable to provide a freezer and method of operation that provides adaptive defrost functionality in an improved and more reliable manner than the known designs.

SUMMARY

In order to achieve the above objectives and improve the art of freezers with adaptive defrost, the present invention provides the following technical solution, in one embodiment. A method of operating a freezer includes operating a refrigeration system to provide cooling to a cabinet via an evaporator during periodic operational cycles. The method also includes monitoring a time elapsed since a most recent defrost cycle of the evaporator was performed or since a startup of the freezer, if there has not been a most recent defrost cycle of the evaporator. It is determined is the time elapsed is greater than a current defrost interval, and if so, a defrost cycle is performed of the evaporator. The method further includes varying the current defrost interval between at least a first, larger time value and a second, smaller time value based on a plurality of trigger signals that are each generated by at least one of a plurality of sensors associated with the refrigeration system and the freezer in response to various operating characteristics of the freezer.

In one aspect, the method further includes resetting the current defrost interval to the first, larger value after completing the defrost cycle. Thus, absent the operating characteristics of the freezer demanding a shorter defrost cycle interval, the freezer operates at the first, larger value of the defrost interval to improve energy efficiency.

In another aspect, when one or more of the plurality of trigger signals is generated to cause a variation of the current defrost interval, the method includes several additional steps. These steps include determining whether the time elapsed since the most recent defrost cycle is greater than or equal to the second, smaller time value. If the time elapsed is greater than or equal to the second, smaller time value, a defrost cycle is scheduled for the evaporator to be performed at a next available opportunity. However, if the time elapsed is less than the second, smaller time value, the method includes proceeding with the step of varying the current defrost interval to set it to the second, smaller time value.

In a further aspect, the plurality of trigger signals that are generated to prompt the varying of the current defrost interval are selected to be indicative of one or more of the following operating characteristics. These operating characteristics include (i) an accumulated open time of a door providing access into the cabinet of the freezer between defrost cycles exceeds a first time threshold; (ii) an ambient temperature outside of the freezer exceeds a first temperature threshold for a predetermined amount of time; (iii) an operational failure of an ambient temperature sensor configured to measure the ambient temperature occurs; (iv) a defrost temperature measured at the evaporator is less than or equal to a second temperature threshold for a predetermined amount of time; (v) an operational failure of a defrost sensor configured to measure the defrost temperature occurs; (vi) a continuous run time of a compressor of the refrigeration system exceeds a second time threshold during the periodic operational cycles; (vii) a continuous run time of the compressor exceeds a third time threshold during a defrost cycle; and (viii) a defrost drip time exceeds or is equal to a fourth time threshold. It will be understood that the particular time thresholds and temperature thresholds may be programmed to meet the needs of the end consumer of the freezer, while also assuring the efficient operation of the freezer.

In yet another aspect, one of the plurality of trigger signals is generated in response to each of the operating characteristics (i)-(viii) listed above, thereby causing the step of varying the current defrost interval to be in response to any of these operating characteristics being determined to be present at the freezer.

In some embodiments, the defrost cycle is defined by delivery of heat energy to evaporator coils of the evaporator and by delivery of het energy to a drain pan located underneath the evaporator coils so as to receive dripping frost and condensate from the evaporator coils during the defrost cycle. In such embodiments, the defrost drip time is measured as starting from a completion of delivery of heat energy to the evaporator coils and ending at either a completion of delivery of heat energy to the drain pan or a completion of the defrost cycle. Alternatively, the defrost cycle can be defined by delivery of heat energy to evaporator coils of the evaporator, in which case the defrost drip time is measured as starting from a completion of delivery of heat energy to the evaporator coils and ending at a completion of the defrost cycle.

In one aspect, upon startup of the freezer, the method includes several additional steps. These steps include determining if the startup is an initial startup or a startup from a power loss condition at the freezer. If the startup is an initial startup, the current defrost interval is set to be equal to the second, smaller time value. If the startup is from a power loss condition, the current defrost interval is set to be equal to a third time value that is even smaller than the second, smaller time value.

In another aspect, the refrigeration system operates to maintain a temperature within the cabinet between an upper control limit temperature and a lower control limit temperature during the periodic operating cycles. The step of performing a defrost cycle further includes several additional steps as follows. First, it is determined if a compressor of the refrigeration system is operating to provide cooling to the cabinet in one of the periodic operating cycles. If the compressor is operating, initiation of the defrost cycle is delayed until the compressor stops operation at an end of a current operating cycle. If the compressor is not operating, it is determined whether the temperature within the cabinet exceeds a predetermined threshold value which is higher than the lower control limit temperature (but may be set very close to the lower control limit temperature, for example). If the temperature within the cabinet is higher than the predetermined threshold value, initiation of the defrost cycle is delayed until after a next compressor operation in the periodic operating cycles. If the temperature within the cabinet is lower than the predetermined threshold value, the defrost cycle is initiated immediately.

In accordance with another embodiment of the invention, a freezer is provided which improves the energy efficiency and use of adaptive defrost. The freezer includes a cabinet having an interior and a door providing access into the interior, and a refrigeration system for cooling the cabinet and defining a fluid circuit for circulating a refrigerant. The refrigeration system has a compressor, a condenser, an expansion device, and an evaporator in fluid communication with the first fluid circuit. The freezer also includes a plurality of sensors associated with the freezer and the refrigeration system for measuring operating characteristics in and around the freezer. A controller is operatively coupled to the refrigeration system, with the controller being configured to operate the freezer as follows. The controller operates the refrigeration system to provide cooling to the cabinet via the evaporator during periodic operational cycles. The controller also monitors a time elapsed since a most recent defrost cycle of the evaporator was performed or since a startup of the freezer, if there has not been a most recent defrost cycle of the evaporator. The controller determines whether the time elapsed is greater than a current defrost interval. If the time elapsed is greater than the current defrost interval, a defrost cycle of the evaporator is performed in response. The controller also varies the current defrost interval between a first, larger time value and a second, smaller time value based on a plurality of trigger signals that are each generated by at least one of the plurality of sensors associated with the refrigeration system and the freezer in response to various operating characteristics of the freezer.

In one aspect, the controller resets the current defrost interval to the first, larger time value after completion of the defrost cycle. Thus, unless operating characteristics at the freezer demand a shorter defrost interval, the system and controller will always default to the longer defrost interval to improve energy efficiency of the freezer. In another aspect, the controller responds to generation of one or more of the plurality of trigger signals by determining whether the time elapsed since the most recent defrost cycle is greater than or equal to the second, smaller time value. If the time elapsed is greater than or equal to this second, smaller time value, a defrost cycle is scheduled to be performed at a next available opportunity, which could be after the end of a current cooling cycle. If the time elapsed is less than the second, smaller time value, the controller proceeds with the step of varying the current defrost interval to set it to the second, smaller time value.

In a further aspect, the plurality of sensors associated with the freezer further includes a door open sensor configured to determine when the door into the cabinet is opened and for how long the door is opened, an ambient temperature sensor positioned to measure an ambient temperature outside of the cabinet, a defrost sensor positioned to measure a defrost temperature at the evaporator, and a compressor sensor tracking operational run times of the compressor. In such embodiments, the plurality of trigger signals to prompt varying of the current defrost interval can be indicative of one or more of the following operating characteristics: (i) an accumulated open time of a door providing access into the cabinet of the freezer between defrost cycles exceeds a first time threshold; (ii) an ambient temperature outside of the freezer exceeds a first temperature threshold for a predetermined amount of time; (iii) an operational failure of an ambient temperature sensor configured to measure the ambient temperature occurs; (iv) a defrost temperature measured at the evaporator is less than or equal to a second temperature threshold for a predetermined amount of time; (v) an operational failure of a defrost sensor configured to measure the defrost temperature occurs; (vi) a continuous run time of a compressor of the refrigeration system exceeds a second time threshold during the periodic operational cycles; (vii) a continuous run time of the compressor exceeds a third time threshold during a defrost cycle; and (viii) a defrost drip time exceeds or is equal to a fourth time threshold. It will be understood that the particular time thresholds and temperature thresholds may be programmed to meet the needs of the end consumer of the freezer, while also assuring the efficient operation of the freezer.

In another aspect, upon startup of the freezer, the controller determines if the startup is an initial startup or a startup from a power loss condition. If the startup is an initial startup, the controller sets the current defrost interval to be equal to the second, smaller time value. If the startup is from a power loss condition, the controller sets the current defrost interval to be equal to a third time value that is even smaller than the second, smaller time value.

BRIEF DESCRIPTION OF THE DRAWINGS

Various additional features and advantages of the invention will become more apparent to those of ordinary skill in the art upon review of the following detailed description of one or more illustrative embodiments taken in conjunction with the accompanying drawings. The accompanying drawings, which are incorporated in and constitute a part of this specification, illustrate one or more embodiments of the invention and, together with the general description given above and the detailed description given below, serve to explain the one or more embodiments of the invention.

DETAILED DESCRIPTION

Figure 1:
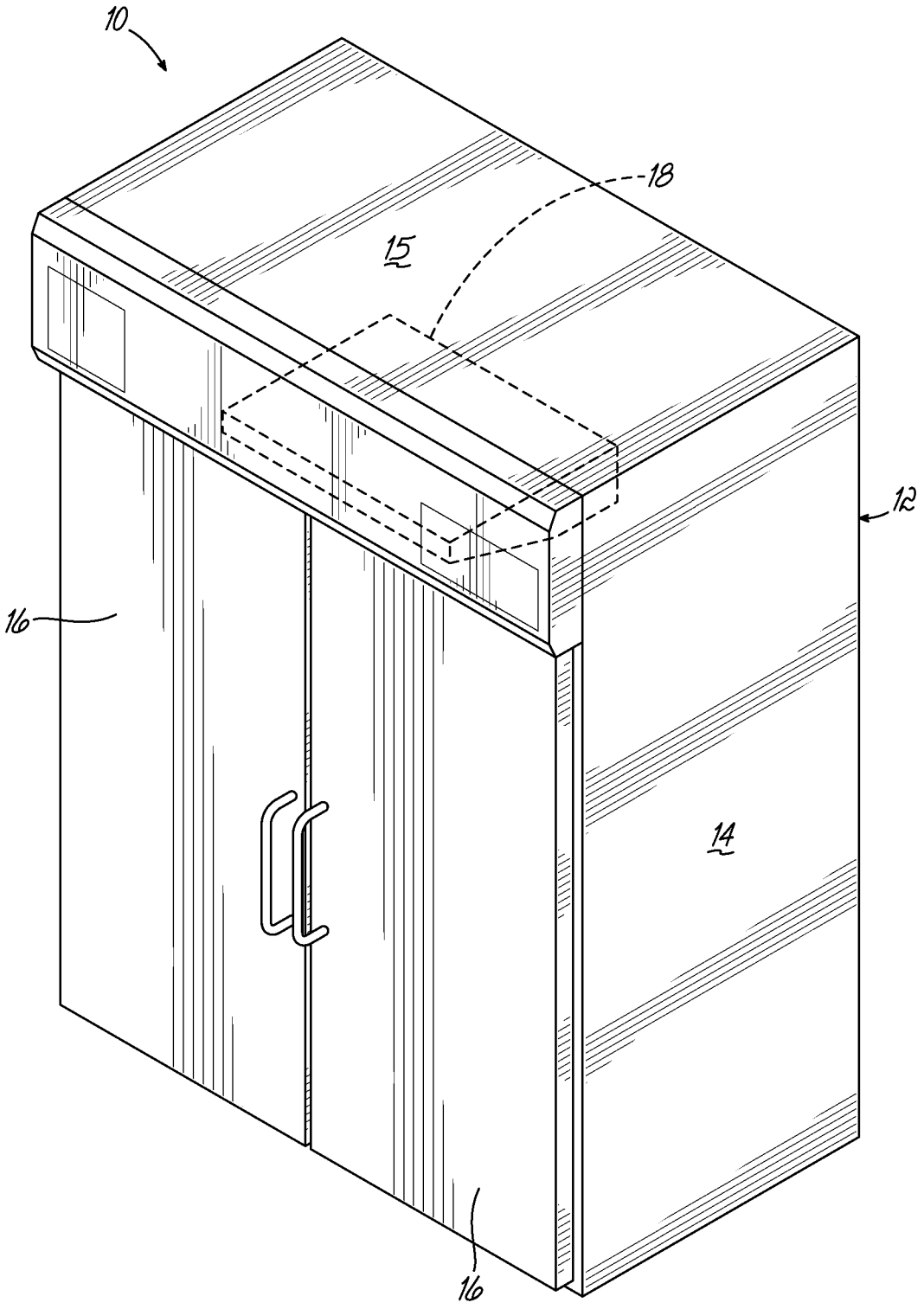
FIG. 1 is a perspective view of an exemplary freezer in accordance with an aspect of the invention.

With reference to FIG. 1, an exemplary freezer 10 according to one embodiment of the present invention is illustrated. The freezer 10 includes a cabinet 12 for storing items that require cooling to temperatures of about 0° C. or lower, for example. The cabinet 12 includes a cabinet housing 14 defining a generally rectangular cross-section and at least one door 16 providing access into an interior of the cabinet 12. The cabinet 12 supports one or more components, such as a compressor and condenser assembly (not shown in FIG. 1) located below a top wall 15 of the cabinet housing 14 and an evaporator assembly 18 located within the interior of the cabinet 12. Alternatively, the evaporator assembly 18 may be located external to the cabinet 12, but be in fluid or thermal communication with the interior of the cabinet 12. In any event, the compressor and condenser assembly and evaporator assembly 18 are fluidly coupled together to jointly define a single-stage refrigeration fluid circuit 20 shown diagrammatically in FIG. 3 that thermally interacts with air within the interior of the cabinet 12 to cool the interior thereof. In this regard, the refrigeration fluid circuit 20 described in further detail below according to an exemplary embodiment interacts with warmed air in the interior and cools this air to maintain a desired cold temperature in the cabinet 12.

According to an aspect of the invention, the freezer 10 is operable to perform adaptive defrost cycles that are spaced apart by varying time intervals which depend on measured or sensed operational characteristics of the freezer 10 that are measured between successive defrost cycles, and/or during a defrost cycle, during operation of the freezer 10 in order to reduce energy usage and to also ensure adequate frost removal for maintaining the integrity of the cargo of the freezer 10. The structural and operational features of the freezer 10 are set forth in further detail below to clarify the advantages and other benefits of the adaptive defrost operation according to an exemplary embodiment of the present invention.

Figure 2A:
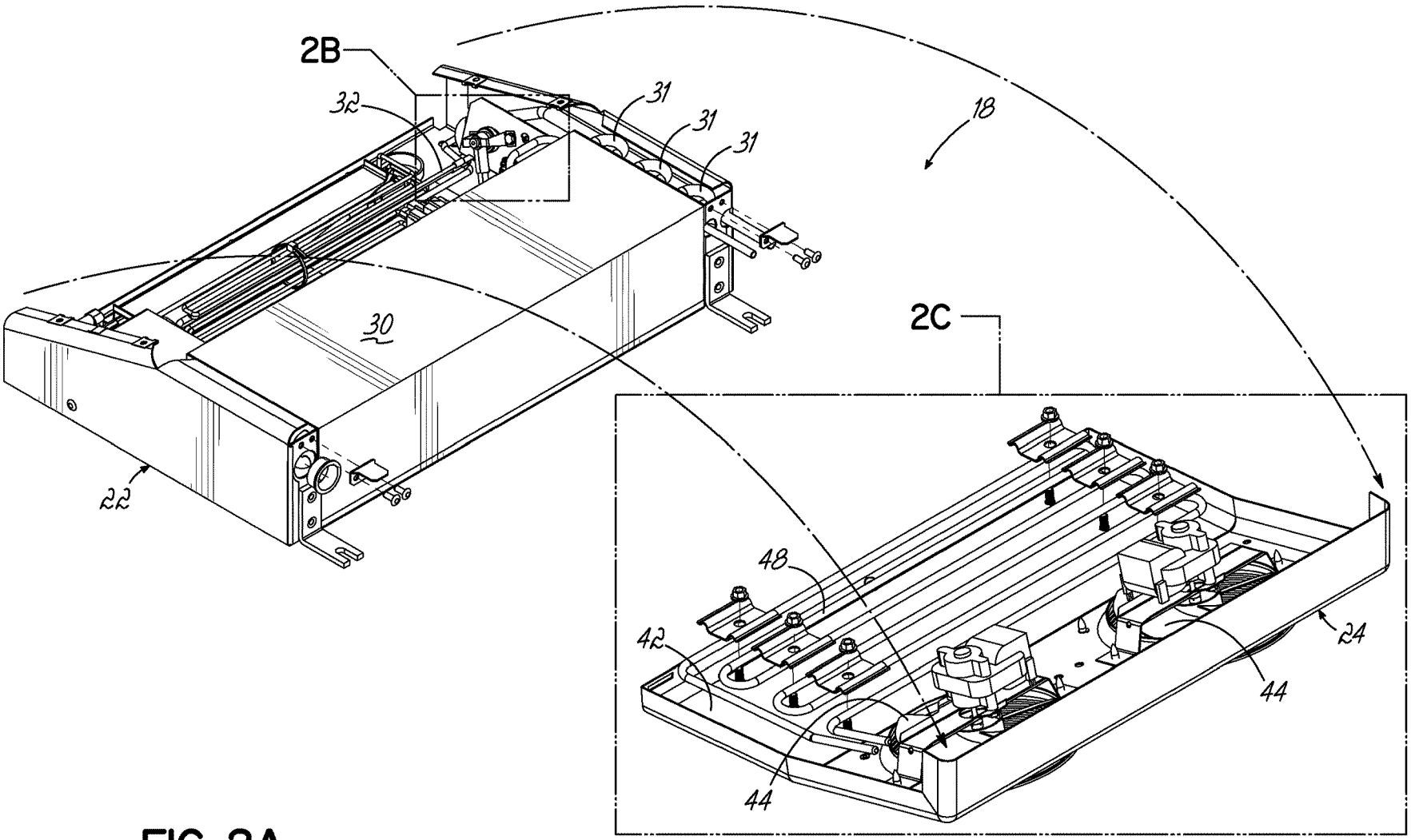
FIG. 2A is a perspective view of the evaporator assembly shown in FIG. 1, showing upper and lower portions of the evaporator assembly decoupled from each other to reveal the components located within the evaporator assembly.
Figure 2B:
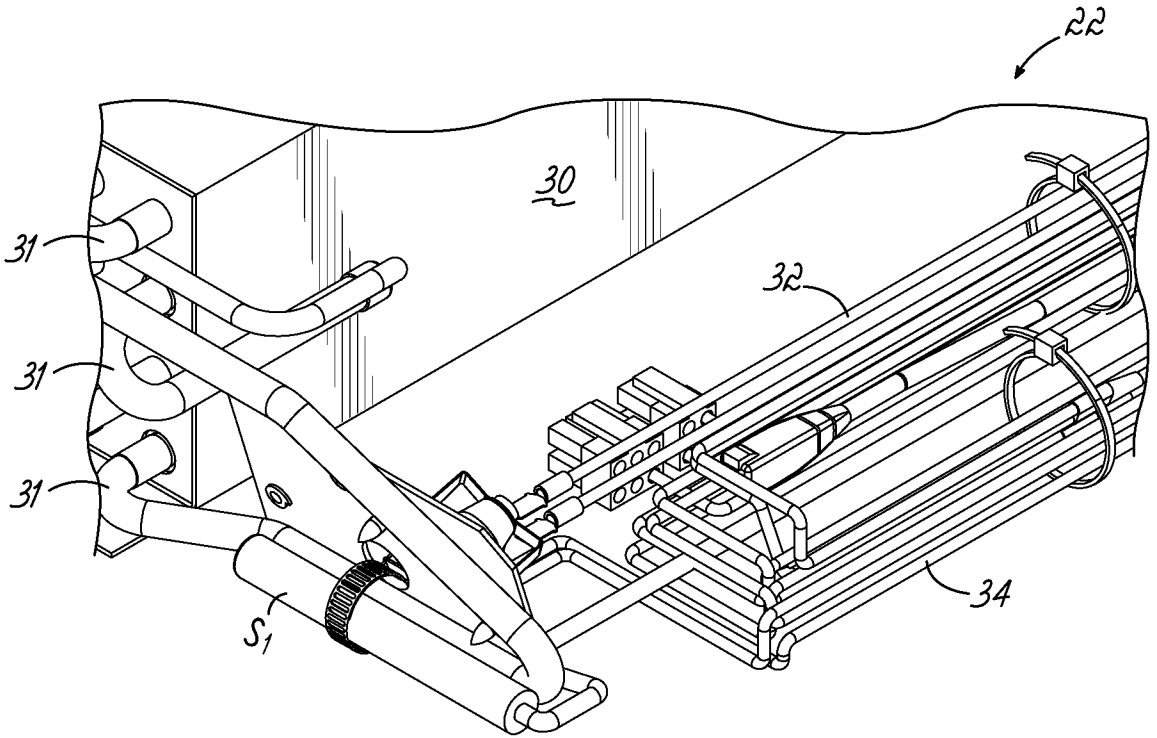
FIG. 2B is a detail perspective view of the upper portion shown in FIG. 2A, taken in area 2B of FIG. 2A and from a different angle than in FIG. 2A.
Figure 2C:
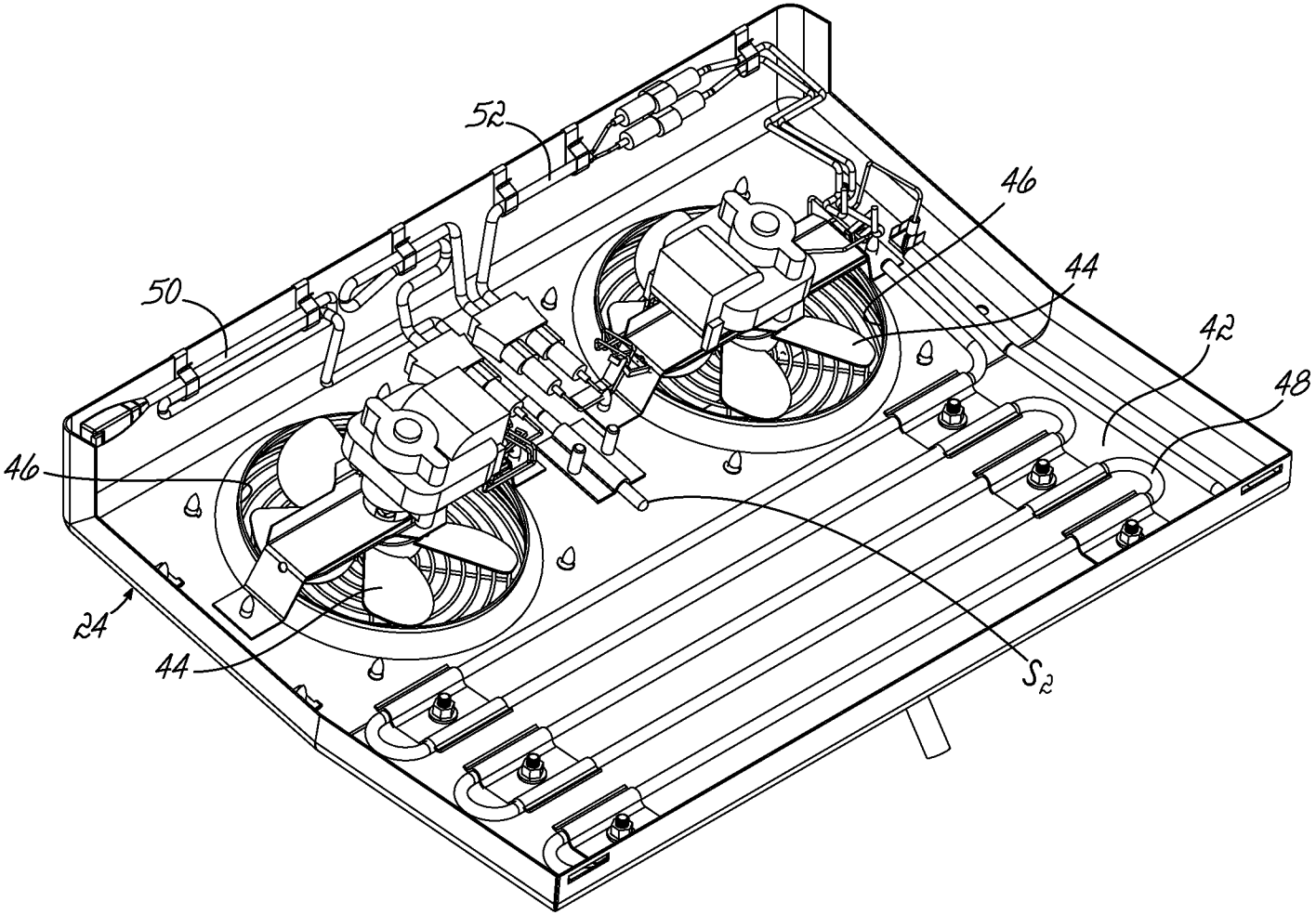
FIG. 2C is a perspective view of the lower portion shown in FIG. 2A, taken in area 2C of FIG. 2A and from a different angle than in FIG. 2A.

The components located within the evaporator assembly 18 are illustrated in FIGS. 2A-2C according to one embodiment. As shown in FIG. 2A, the evaporator assembly 18 is shown disassembled and may include an upper portion 22 and a lower portion 24 that are removably coupled to each other. The illustrated upper portion 22 (shown in FIGS. 2A and 2B) includes an evaporator housing 30 enclosing evaporator coils 31. As best shown in FIG. 2B, the upper portion 22 further includes a defrost sensor $S_1$ that is configured to measure the defrost temperature of the evaporator 30 (e.g., the evaporator coils 31) at or near the outlet of the evaporator coils 31. Wiring harnesses 32, 34 operatively couple the defrost sensor $S_1$ to a power source (not shown) and a controller 40 (FIG. 3) of the freezer 10. The use of the defrost sensor $S_1$ is described in greater detail below.

FIGS. 2A and 2C show a drain pan 42 provided on an interior side of the lower portion 24 of the evaporator assembly 18 for collecting condensate which drips from the evaporator 30. FIGS. 2A and 2C each also show, from a different angle, at least one single speed or variable speed fan 44 positioned in at least one corresponding opening 46 formed through the lower portion 24 of the housing 30 for forcing cooled air from the evaporator 30 into the interior of the cabinet 12. As shown in FIG. 2C, the drain pan 42 includes a drain pan heater 48 configured to supply heat to the drain pan 42 and the contents thereof, such as during a defrost cycle of the freezer 10. A drain pan sensor $S_2$ is mounted to the lower portion 24 of the housing 30 and is configured to measure the temperature within the drain pan 42 and/or the contents thereof. Wiring harnesses 50, 52 operatively couple the drain pan sensor $S_2$ and/or fan(s) 44 to a power source and the controller 40 of the freezer 10. In one embodiment, the drain pan heater 48 and/or drain pan sensor $S_2$ may be eliminated, such as when rendered superfluous by the geometry of the evaporator housing 30 and/or drain pan 42. For example, the drain pan heater 48 and/or drain pan sensor $S_2$ may be eliminated in embodiments wherein the drain pan 42 is oriented to slope substantially steeper than that shown in the figures such that condensate on the drain pan 42 is directed downwardly under the force of gravity.

Figure 3:
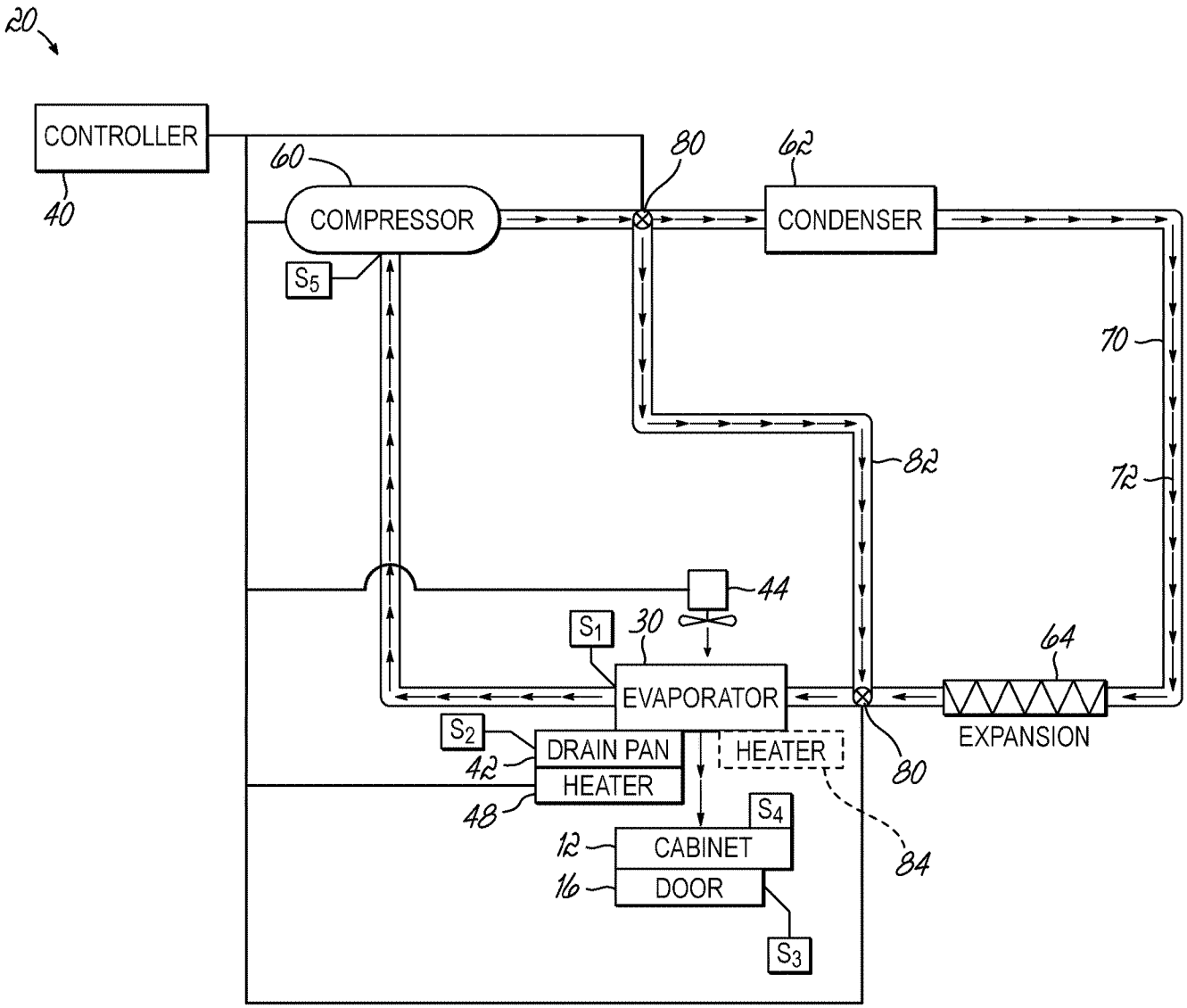
FIG. 3 is a schematic representation of the refrigeration fluid circuit of the freezer of FIG. 1.

With reference to FIG. 3, details of the exemplary refrigeration fluid circuit 20 are shown. The refrigeration fluid circuit 20 includes, in sequence, a single speed compressor or variable speed compressor (VSC) 60, a condenser 62, an expansion device 64, and the evaporator 30. While not shown, the refrigeration fluid circuit 20 may further include various other components known in the art, such as an oil separator, a filter/dryer, a receiver and/or a suction/accumulator. Each of these elements of the refrigeration fluid circuit 20 is fluidly coupled by suitable piping or tubing 70 configured to circulate a refrigerant 72 within the fluid or refrigerant circuit 20. In one embodiment, the fluid circuit 20 is configured to circulate a hydrocarbon-based refrigerant, such as R290 refrigerant, although any other suitable refrigerant for achieving the desired temperature in accordance with the principles of the present invention is contemplated. Likewise, while the refrigeration fluid circuit 20 is shown in FIG. 3 to be a single-stage refrigeration system, it will be understood that the same inventive concepts related to adaptive defrost may be implemented on different refrigeration circuits including cascaded circuits that operate to draw temperatures within the cabinet of a freezer down to ultra-low temperatures (ULT freezers) without departing from the scope of the invention.

In one embodiment, the freezer 10 is configured to direct hot gas from the compressor 60 to the evaporator 30, such as via a pair of electric valves 80 and a bypass conduit 82, so that the hot gas from the compressor 60 is circulated directly to the evaporator coils 31 for the purpose of defrosting the evaporator coils 31 during a defrost cycle. This configuration is used in hot gas-based adaptive defrost cycles. If the compressor 60 is a VSC, the speed of the compressor 60 may be varied during the defrost cycle to optimize the efficiency thereof, and/or also during normal cooling operation of the freezer 10. In addition or alternatively, the freezer 10 may include a defroster in the form of one or more dedicated defrost heaters (e.g., see optional heater 84 shown in dotted lines in FIG. 3) configured to remove frost from the evaporator 30 (e.g., by externally heating the evaporator coils 31) during heater-based adaptive defrost cycles. As set forth below, a defrost drip pan heater may also be used in the defrost cycle in this and other embodiments, and it will be understood that the adaptive defrost methods of the invention described herein can be used irrespective of the particular defrost equipment and methodology used at the freezer 10.

In an exemplary hot gas adaptive defrost cycle according to one embodiment of the present invention, the controller 40 is operatively coupled to the pair of electric valves 80, and is also operatively coupled to additional components of the freezer 10 such as, for example, the compressor 60, fan(s) 44, and drain pan heater 48, to permit controlling of the operation of the freezer 10 during each normal cooling operation of the freezer 10 and during each adaptive defrost cycle. A plurality of sensors $S_1$-$S_5$ are arranged to sense different operating conditions of the freezer 10 at various locations within and outside the fluid circuit 20 of the freezer 10, and are each operatively coupled to the controller 40 as described in greater detail below.

With continuing reference to FIG. 3, the illustrated plurality of sensors $S_1$-$S_5$ includes the previously described defrost temperature sensor $S_1$ configured to measure the defrost temperature of the evaporator 30 (e.g., at or near the outlet of the evaporator coils 31). The drain pan temperature sensor $S_2$ is provided at or near the surface of the drain pan 42 and is configured to measure the temperature in the vicinity of the surface of the drain pan 42 and/or the contents thereof. The plurality of sensors $S_1$-$S_5$ also includes a door open sensor $S_3$ which is configured to detect the opening and closing of the door(s) 16 of the cabinet 12, an ambient temperature sensor $S_4$ located generally proximate the freezer 10 which is configured to measure the ambient temperature outside of the freezer 10, and a compressor activity sensor $S_5$ which is configured to detect running operation time of the compressor 60. The plurality of sensors $S_1$-$S_5$ are each configured to generate and send a signal to the controller 40 representative of each respective measured condition, and the controller 40 is configured to process the respective signals and operate the freezer 10 according to an adaptive defrost routine described in greater detail below. As will be described in greater detail below, the controller 40 may adjust a set time interval between successive defrost cycles in response to the respective signals received from one or more of the plurality of sensors $S_1$-$S_5$. For example, as described in greater detail below, a set time interval of 15 hours between successive defrost cycles may be adjusted or reset to a set time interval of 6 hours between successive defrost cycles, or a set time interval of 6 hours between successive defrost cycles may be adjusted or reset to 15 hours between successive defrost cycles in accordance with one embodiment of the present invention.

Figure 4:
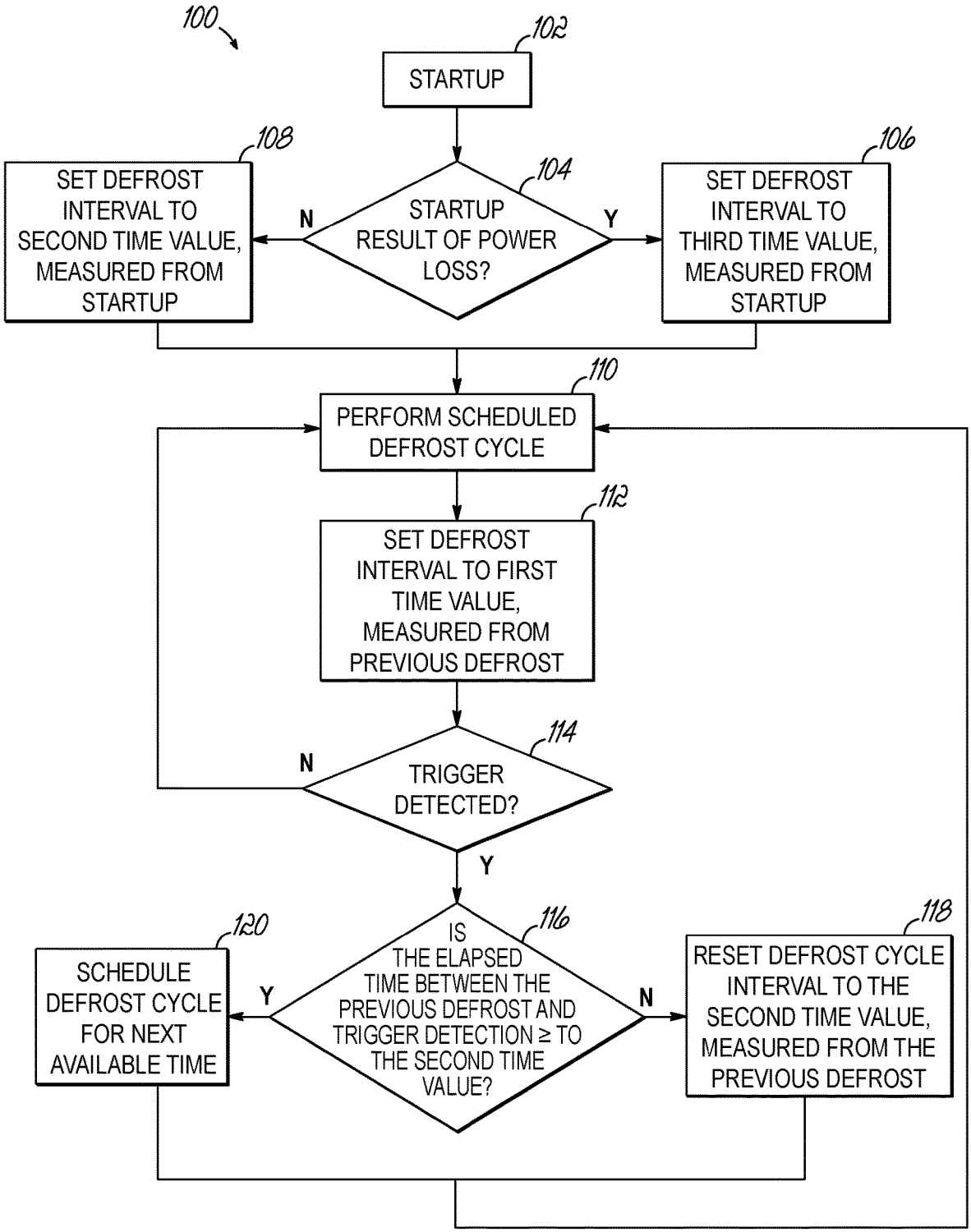
FIG. 4 is a schematic flowchart illustrating an operational sequence of a controller associated with the freezer of FIG. 1.

An exemplary operation of the freezer 10 is shown schematically in the flowchart of FIG. 4. In this regard, the controller 40 is operable to command the freezer 10 to execute the steps of the method 100 shown in FIG. 4. As will be described in further detail below, the freezer 10 operates with adaptive defrost that varies the current defrost interval between defrost cycles between at least a first, larger time value (e.g., 15 hours in accordance with one exemplary embodiment) and a second, smaller time value (e.g., 6 hours in accordance with the exemplary embodiment). Different time values for the defrost intervals may be used in other embodiments of the invention, but this example is provided as one working example used by the original Applicant of the present invention in one implementation of the adaptive defrost method and freezers.

Returning to FIG. 4, the controller 40 first performs a startup 102, which may include activating at least the compressor 60 and fan(s) 44 of the freezer 10. At step 104, the controller 40 determines whether the startup is an initial startup or the result of loss of power to the freezer 10. If the startup resulted from a power loss, then the controller 40 sets the defrost cycle time interval to a third time value that is smaller than the first and second time values (e.g., 4 hours in an exemplary embodiment) from the startup at step 106, such that a defrost cycle is scheduled to be performed at a time equal to the third time value after the startup. If, on the other hand, the startup is an initial startup that did not result from a power loss, then the controller 40 sets the defrost cycle time interval to the second, smaller time value from the startup at step 108, such that a defrost cycle is scheduled to be performed after the second time value has passed following the startup. In any case, the controller 40 subsequently performs the scheduled hot gas defrost cycle at the scheduled time at step 110, such as via the pair of electric valves 80 and bypass conduit 82.

Upon completion of this first scheduled defrost cycle, the controller 40 automatically sets the defrost cycle time interval to the first, larger time value after the previous defrost cycle at step 112, such that a defrost cycle is scheduled to be performed at a time equal to the first time value after the first defrost cycle.

During each normal cooling cycle after the first scheduled defrost cycle, the controller 40 continuously monitors whether a trigger signal (discussed in greater detail below), as measured or sensed by one or more of the sensors $S_1$-$S_5$, has been detected by the controller 40 at step 114. If no trigger signal is detected by the controller 40, the controller 40 simply performs the scheduled defrost cycle at the originally scheduled time (e.g., 15 hours after the previous defrost cycle, in the exemplary embodiment) by returning to step 110.

If, on the other hand, a trigger signal is detected by the controller 40 at step 114, the controller 40 may alter the set defrost cycle time interval. In this regard, the controller 40 first determines whether a time greater than or equal to the second, smaller time value has elapsed between the conclusion of the previous defrost cycle and the time of the trigger signal detection at step 116. The controller 40 then either resets the current defrost interval from the first time value after the previous defrost cycle to the second time value after the previous defrost cycle if less than 6 hours have elapsed between the conclusion of the previous defrost cycle and the time of the trigger signal detection at step 118, or performs a defrost cycle at the next available time (e.g., an off cycle of the compressor 60, unless circumstances allow for an immediate defrost as set forth in FIG. 6 and the corresponding description below) if more than the second time value has elapsed between the conclusion of the previous defrost cycle and the time of the trigger signal detection at step 120. The controller 40 subsequently performs the scheduled defrost cycle by returning to step 110. Upon completion of each defrost cycle according to step 110, the controller 40 automatically sets the defrost cycle time interval to the first, larger time value after the previous defrost cycle at step 112 and proceeds to continuously monitor whether a trigger is detected at step 114, and so forth. In one embodiment, the controller 40 may only set the defrost cycle time interval to the first time value after the previous defrost cycle if both the defrost and ambient sensors $S_1$, $S_4$, respectively, are functional. In this regard, if either of the defrost and/or ambient sensors $S_1$, $S_4$ are not functional the freezer 10 may go into a limp mode that runs based on time to typical cycles/defrosts, and the defrost cycle time interval may remain at the second, smaller time value.

In any event, each defrost cycle time interval following the first defrost cycle after startup is subject to being reset as described above upon a subsequent trigger signal detection. Thus, the larger first time interval automatically set for each defrost cycle after the first defrost may be considered the "default" defrost cycle time interval, and the smaller second time interval resulting from a trigger signal detection may be considered the "varied" defrost cycle time interval. While 15-hour and 6-hour time intervals are described herein as the default and varied defrost cycle time intervals, respectively, it will be appreciated that any suitable time intervals may be used wherein the varied defrost cycle time interval is less than the default defrost cycle time interval such that the varied defrost cycle time interval is a reduced defrost cycle time interval relative to the default defrost cycle time interval. In some embodiments, a plurality of varied defrost cycle time intervals may be used. For example, a first varied defrost cycle time interval may result from a first trigger signal detection and a second varied defrost cycle time interval different from the first varied defrost cycle time interval may result from a second trigger signal detection different from the first trigger signal detection.

Figure 5:
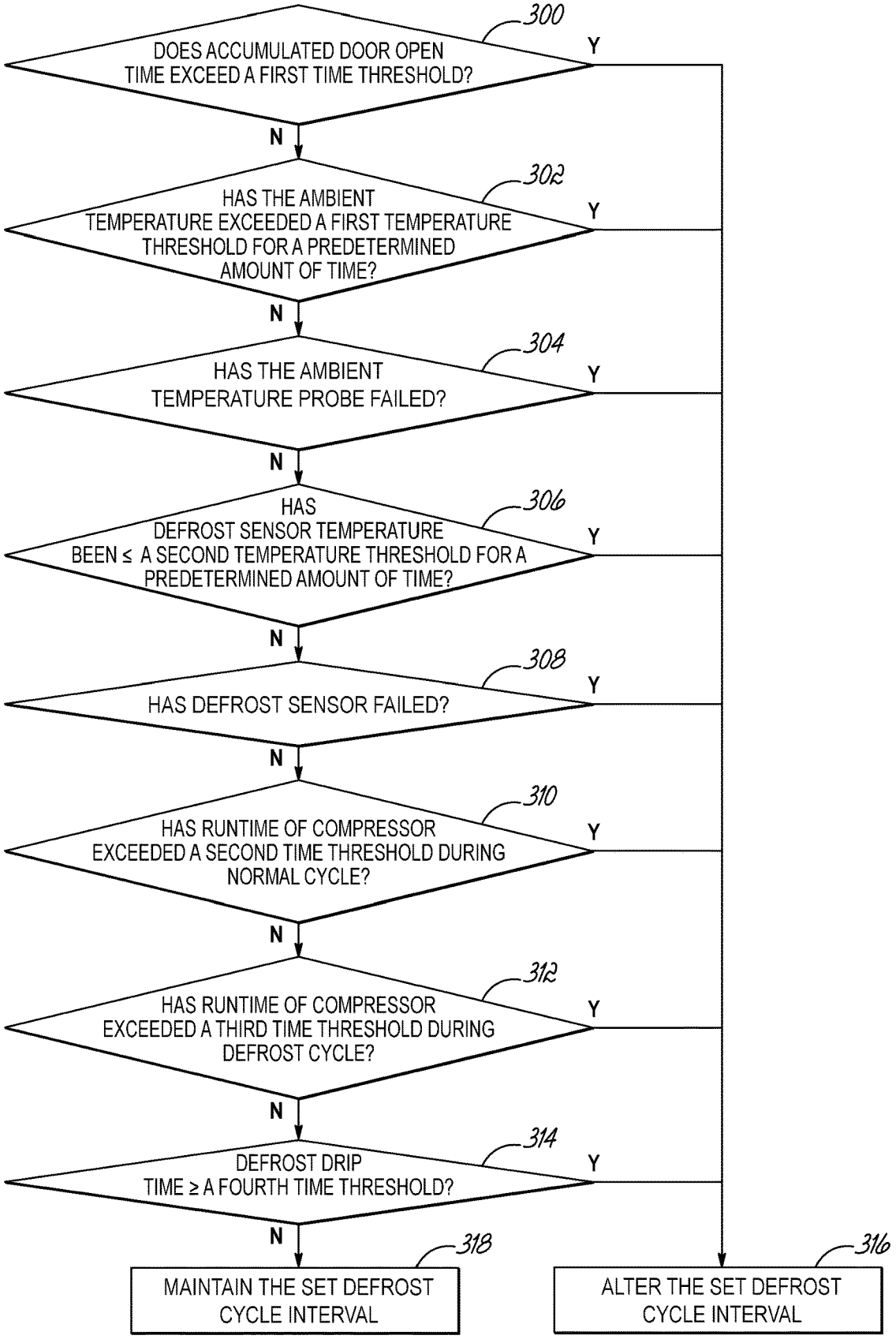
FIG. 5 is a schematic flowchart illustrating various triggers for prompting the controller to alter a defrost cycle time interval of the freezer of FIG. 1.

Referring now to FIG. 5, a plurality of trigger signals 300-314 may prompt the controller 40 to alter the set defrost cycle time interval from the default time interval to the varied time interval. As shown, the controller 40 may determine whether the accumulated door open time exceeds a first time threshold at step 300. In one embodiment, the opening and closing of the door 16 of the cabinet 12 may be communicated to the controller 40 by the door open sensor $S_3$, and the controller 40 may track the accumulated door open time for any door opening since completion of the previous defrost cycle via a timer. The first time threshold may be set to 6 minutes, in one exemplary embodiment, but it will be understood that the specific numerical value of this threshold can be varied in other embodiments of the invention. In response to the accumulated door open time exceeding the first time threshold, the controller 40 may alter the set defrost cycle time interval as discussed above at step 316. The controller 40 may restart the accumulated door open time at zero upon completion of each defrost cycle.

As shown, the controller 40 may also determine whether the ambient temperature has exceeded a first temperature threshold for a predetermined period of time at step 302 via a timer. In one embodiment, the ambient temperature sensor $S_4$ may be configured to communicate the measured ambient temperature to the controller 40, and the controller 40 may continuously monitor the measured ambient temperature. The first temperature threshold may be set to 30° C. and the predetermined period of time may be set to 3 hours in one exemplary embodiment, but it will be understood that the specific numerical value of this threshold and period of time can be varied in other embodiments of the invention. In response to the ambient temperature being greater than the first temperature threshold for the predetermined period of time, the controller 40 may alter the set defrost cycle time interval as discussed above at step 316. The controller 40 may also determine whether the ambient temperature sensor $S_4$ has failed at step 304. For example, the controller 40 may alter the set defrost cycle time interval in response to an interruption in communication between the controller 40 and the ambient temperature sensor $S_4$.

The controller 40 may also determine whether the defrost temperature as sensed by the defrost temperature sensor $S_1$ has been less than or equal to a second temperature threshold for a predetermined amount of time at step 306 via a timer. In one embodiment, the defrost temperature sensor $S_1$ may be configured to communicate the measured defrost temperature of the evaporator 30 to the controller 40, and the controller 40 may continuously monitor the measured defrost temperature. The second temperature time threshold may be set to −40° C. and the predetermined amount of time may be set to 1 continuous hour, in one exemplary embodiment, but it will be understood that the specific numerical value of this threshold and predetermined amount of time can be varied in other embodiments of the invention. In response to the defrost temperature as measured by the defrost temperature sensor $S_1$ being less than or equal to the second temperature threshold for the predetermined amount of time, the controller 40 may alter the set defrost cycle time interval as discussed above at step 316. The controller 40 may also determine whether the defrost temperature sensor $S_1$ has failed at step 308. For example, the controller 40 may alter the set defrost cycle time interval in response to an interruption in communication between the controller 40 and the defrost temperature sensor $S_1$.

The controller 40 may determine whether the runtime of the compressor 60 during a normal cooling cycle has exceeded a second time threshold of continuous run at step 310 via a timer. In one embodiment, the compressor activity sensor $S_5$ may be configured to communicate operation of the compressor 60 to the controller 40, and the controller 40 may be configured to track the runtime of the compressor 60 during each normal cooling cycle. The second time threshold may be set to 3 continuous hours, in one exemplary embodiment, but it will be understood that the specific numerical value of this threshold can be varied in other embodiments of the invention. In response to the runtime exceeding the second time threshold during a normal cooling cycle, the controller 40 may alter the set defrost cycle time interval as discussed above at step 316. In one embodiment, the controller 40 itself may detect operation of the compressor 60 via the operative communication between the controller 40 and the compressor 60 such that the compressor activity sensor $S_5$ may be eliminated.

The controller 40 may also determine whether the runtime of the compressor 60 during a defrost cycle has exceeded a third time threshold of continuous run at step 312 via a timer. In one embodiment, the compressor activity sensor $S_5$ may be configured to communicate operation of the compressor 60 to the controller 40, and the controller 40 may be configured to track the runtime of the compressor 60 during each defrost cycle. The third time threshold may be set to 10 continuous minutes, in one exemplary embodiment, but it will be understood that the specific numerical value of this threshold can be varied in other embodiments of the invention. In response to the runtime exceeding the third time threshold during a defrost cycle, the controller 40 may alter the set defrost cycle time interval as discussed above at step 316. In one embodiment, the controller 40 itself may detect operation of the compressor 60 via the operative communication between the controller 40 and the compressor 60 such that the compressor activity sensor $S_5$ may be eliminated.

The controller 40 may determine whether the defrost drip time is greater than or equal to a fourth time threshold at step 314 via a timer. In one embodiment, the drain pan temperature sensor $S_2$ may be configured to communicate the measured temperature of the drain pan 42 to the controller 40, and the controller 40 may be configured to track the defrost drip time, at least in embodiments that use a drain pan heater. The fourth time threshold may be set to 5 minutes, in one exemplary embodiment, but it will be understood that the specific numerical value of this threshold can be varied in other embodiments of the invention. It will be appreciated that the defrost trip time may be, for example, the period of time beginning after the evaporator coil defrost is complete, which may be determined by the defrost temperature of the evaporator 30 reaching a threshold value such as 3° C., until the drain pan defrost and/or overall defrost is completed via the drain pan heater 48. The defrost drip time may be terminated by the drain pan temperature sensor $S_2$ measuring a predetermined threshold temperature in the drain pan 42, such as 3° C., or by timing out at a maximum time limit, such as at the fourth time threshold measured from the beginning of the defrost drip time. In response to the defrost drip time terminating either by achieving the threshold temperature or by timing out, the drain pan heater 48 may be shutoff. In response to the defrost drip time timing out (e.g., reaching the maximum time limit without achieving the threshold temperature), the controller 40 may alter the set defrost cycle time interval as discussed above at step 316. In one embodiment, the defrost drip time may be subject to a minimum time limit, such as 1 minute from the beginning of the defrost drip time.

If none of the trigger signals 300-314 are detected during a normal cooling cycle of the freezer 10 after the first defrost, then the controller 40 may maintain the current defrost interval at step 318. Any of all of these trigger signals 300-314 may be used to control variations of the current defrost interval in embodiments of this invention. Because a plurality of trigger signals are used to switch the current defrost interval, the performance of when defrost cycles are initiated at the freezer 10 can be better-suited to all the operating characteristics that may affect evaporator and cooling performance, thereby improving the responsiveness of this adaptive defrost system as compared to known designs.

Figure 6:
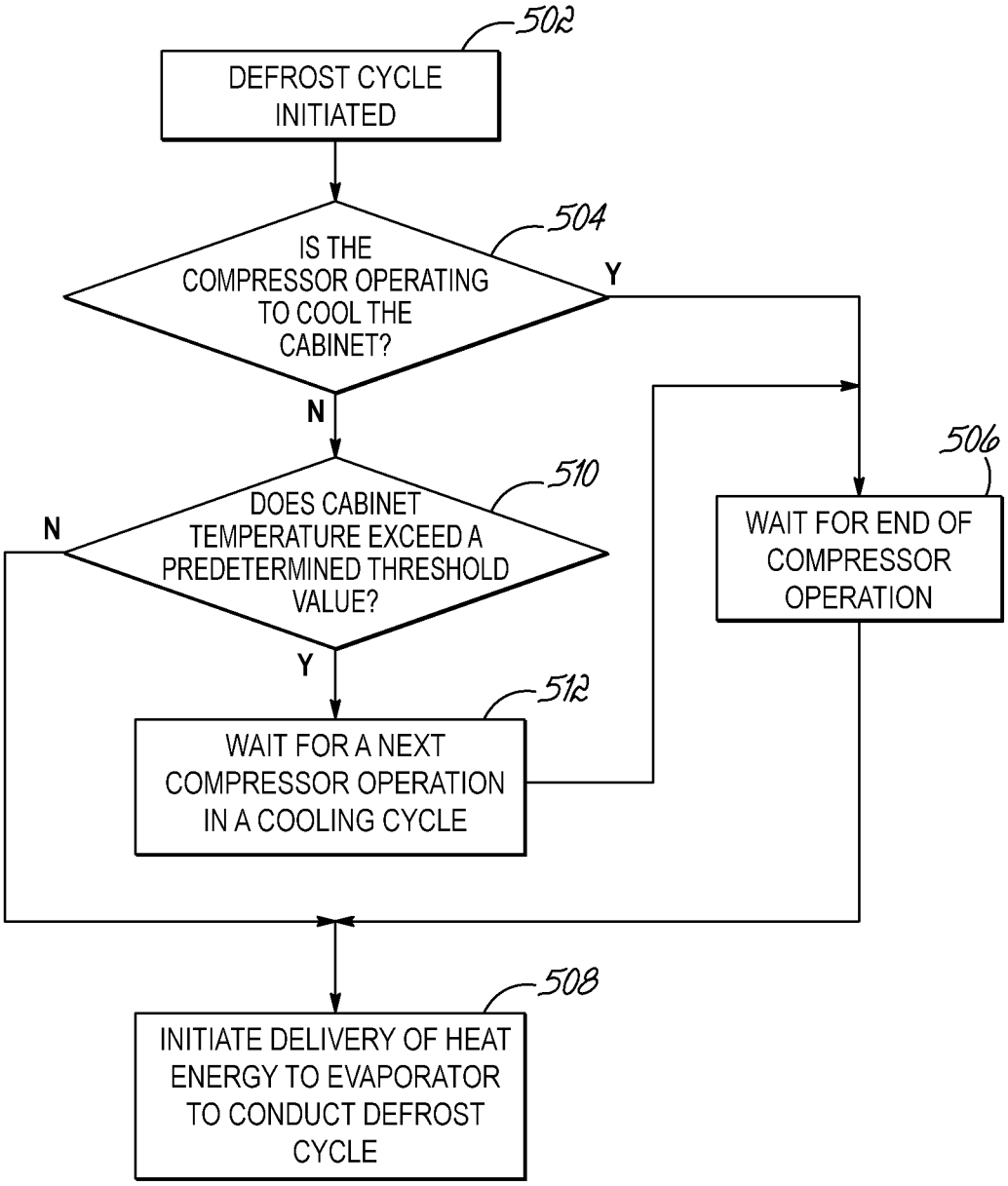
FIG. 6 is a schematic flowchart illustrating an operational sequence of actions that the controller performs when a defrost cycle is initiated at the freezer of FIG. 1.

Now turning with reference to FIG. 6, an additional aspect of how the controller 40 operates the freezer 10 in an exemplary embodiment is shown in flowchart form. This flowchart may be considered a summary of some of the actions taken at step 110 in FIG. 4 whenever a scheduled defrost cycle is to be performed. To this end, the refrigeration fluid circuit 20 and the controller 40 operate during normal operation to maintain a temperature within the cabinet 12 between an upper control limit temperature and a lower control limit temperature. To this end, when the temperature in the cabinet 12 exceeds the upper control limit temperature, the compressor 60 is operated so as to provide cooling at the evaporator 30 of heat energy in the cabinet 12, and the compressor 60 can be run in a cooling cycle until the temperature in the cabinet 12 reaches the lower control limit temperature. With this background on normal cooling cycles, the additional steps shown in FIG. 6 can now be described in detail.

When a defrost cycle is initiated at step 502, the freezer 10 has been detected to operate for longer than the current defrost interval, whatever that interval is currently set to. The controller 40 then determines at step 504 whether the compressor 60 is operating in a cooling cycle to provide cooling to the cabinet 12 as set forth in the description of the periodic cooling cycles above. If the compressor 60 is operating, then the controller 40 delays the initiation of heat energy application to defrost the evaporator 30 until the compressor stops operation at the end of the cooling cycle. To this end, as shown in step 506, the controller 40 monitors the compressor 60 to wait for the end of the cooling cycle, at which point the heat energy application to conduct the defrost is performed at step 508. If the compressor 60 is not operating at the determining step of step 504, then the controller 40 determines at step 510 if the temperature within the cabinet 12 exceeds a predetermined threshold value, which is set to be higher than the lower control limit temperature, but only by a small amount. For example, if the lower and upper control limit temperatures differ from one another by a control range of about 0.6° C. in an exemplary embodiment, the predetermined threshold value may be set to be about 0.05° C. to 0.1° C. above the lower control limit temperature. In this regard, the predetermined threshold temperature is designed to evaluate whether a periodic cooling cycle has ended recently enough such that the temperature in the cabinet 12 is near the lower control limit, which is the preferred temperature for initiating the defrost cycle. Consequently, if the controller 40 determines that the cabinet temperature exceeds the predetermined threshold value at step 510, the controller 40 delays the defrost cycle by waiting for a next compressor operation in the next cooling cycle to occur at step 512 (including waiting for the end of the compressor operation at step 506). If, on the other hand, the controller 40 determines that the cabinet temperature is less than the predetermined threshold value, the controller 40 moves to step 508 to initiate the heat energy application to conduct the defrost cycle immediately. Thus, the defrost cycle will always be initiated advantageously at a low end of the control range of temperatures used for the cabinet 12, but in certain cases, this will not necessitate a delay until the end of the next periodic cooling cycle (thereby improving the effectiveness of the defrost by not waiting through another cooling cycle in some circumstances).

Those skilled in the art will understand that one or more of the values described herein for temperature and/or elapsed time and/or time intervals may be varied, such as depending on a setpoint of the freezer 10. For example, the values described herein may be particularly suitable for a freezer 10 having a setpoint temperature of about −37° C., but one or more of those values could be scaled for a freezer 10 that is set to a different setpoint temperature (e.g., such as the alternative embodiment applying these concepts to a cascaded refrigeration system in a ULT) as will be understood by those of ordinary skill in the art.

While the present invention has been illustrated by the description of various embodiments thereof, and while the embodiments have been described in considerable detail, it is not intended to restrict or in any way limit the scope of the appended claims to such detail. Thus, the various features discussed herein may be used alone or in any combination. Additional advantages and modifications will readily appear to those skilled in the art. For example, while three different time values are described for use as current defrost intervals in the embodiments summarized above, the adaptive defrost methods and controls described herein could also be used in other embodiments in which four or more different time values are switched between for the current defrost interval. The present invention in its broader aspects is therefore not limited to the specific details and illustrative examples shown and described. Accordingly, departures may be made from such details without departing from the scope of the general inventive concept.

What is claimed is:

1. A method of operating a freezer which includes a cabinet and a refrigeration system including an evaporator and a compressor, the method comprising:

operating the refrigeration system to provide cooling to the cabinet during periodic operational cycles of the compressor;

monitoring a time elapsed since a most recent defrost cycle of the evaporator was performed or since a startup of the freezer, if there has not been a most recent defrost cycle of the evaporator;

determining whether the time elapsed is greater than a current defrost interval;

performing a defrost cycle of the evaporator in response to determining that the time elapsed is greater than the current defrost interval;

varying the current defrost interval between at least a first, larger predetermined time value and a second, smaller predetermined time value based on a plurality of trigger signals that are each generated by at least one of a plurality of sensors associated with the refrigeration system and the freezer in response to various operating characteristics of the freezer; and independent of a total duration of the defrost cycle, automatically resetting the current defrost interval to the first, larger time value after completion of the defrost cycle unless a continuous run time of the compressor is equal to or exceeds a runtime threshold during the defrost cycle or a defrost drip time is equal to or exceeds a drip time threshold during the defrost cycle which results in setting the current defrost interval to the second, smaller predetermined time value.

2. The method of claim 1, wherein when one or more of the plurality of trigger signals is generated to cause variation of the current defrost interval, the method further comprises:

determining whether the time elapsed since the most recent defrost cycle is greater than or equal to the second, smaller time value;

if the time elapsed is greater than or equal to the second, smaller time value, scheduling a defrost cycle for the evaporator to be performed after the end of a current periodic operational cycle; and if the time elapsed is less than the second, smaller time value, proceeding with the step of varying the current defrost interval to set it to the second, smaller time value.

3. The method of claim 1, wherein the plurality of trigger signals that are generated to prompt the varying of the current defrost interval is selected to be indicative of one or more of the following operating characteristics:

(i) an accumulated open time of a door providing access into the cabinet of the freezer between defrost cycles exceeding a first time threshold;

(ii) an ambient temperature outside of the freezer exceeding a first temperature threshold for a predetermined amount of time;

(iii) an operational failure of an ambient temperature sensor configured to measure the ambient temperature;

(iv) a defrost temperature measured at the evaporator being less than or equal to a second temperature threshold for a predetermined amount of time;

(v) an operational failure of a defrost sensor configured to measure the defrost temperature;

(vi) a continuous run time of a compressor of the refrigeration system exceeding a second time threshold during the periodic operational cycles;

(vii) a continuous run time of the compressor exceeding a third time threshold during a defrost cycle; and (viii) a defrost drip time exceeding or being equal to a fourth time threshold.

4. The method of claim 3, wherein one of the plurality of trigger signals is generated in response to each of the operating characteristics (i)-(viii), thereby causing the step of varying the current defrost interval in response to any of these operating characteristics being determined at the freezer.

5. The method of claim 3, wherein the defrost cycle is defined by delivery of heat energy to evaporator coils of the evaporator and delivery of heat energy to a drain pan located underneath the evaporator coils so as to receive dripping frost and condensate from the evaporator coils during the defrost cycle, and wherein the defrost drip time is measured as starting from a completion of delivery of heat energy to the evaporator coils and ending at either a completion of delivery of heat energy to the drain pan or a completion of the defrost cycle.

6. The method of claim 3, wherein the defrost cycle is defined by delivery of heat energy to evaporator coils of the evaporator, and wherein the defrost drip time is measured as starting from a completion of delivery of heat energy to the evaporator coils and ending at a completion of the defrost cycle.

7. The method of claim 1, wherein upon the startup of the freezer, the method further comprises:

determining if the startup is an initial startup or a startup from a power loss condition;

if the startup is an initial startup, setting the current defrost interval to be equal to the second, smaller time value; and if the startup is from a power loss condition, setting the current defrost interval to be equal to a third time value that is even smaller than the second, smaller time value.

8. The method of claim 1, wherein the refrigeration system operates to maintain a temperature within the cabinet between an upper control limit temperature and a lower control limit temperature during the periodic operating cycles, and wherein the step of performing a defrost cycle of the evaporator in response to determining that the time elapsed is greater than the current defrost interval further comprises:

determining if a compressor of the refrigeration system is operating to provide cooling to the cabinet in one of the periodic operating cycles;

if the compressor is operating, delaying initiation of the defrost cycle until the compressor stops operation at an end of a current operating cycle;

if the compressor is not operating, determining if the temperature within the cabinet exceeds a predetermined threshold value which is higher than the lower control limit temperature;

if the temperature within the cabinet is higher than the predetermined threshold value, delaying initiation of the defrost cycle until after a next compressor operation in the periodic operating cycles; and if the temperature within the cabinet is lower than the predetermined threshold value, initiating the defrost cycle immediately.

9. A freezer, comprising:

a cabinet having an interior and a door providing access into the interior;

a refrigeration system for cooling the cabinet and defining a fluid circuit for circulating a refrigerant, the refrigeration system having a compressor, a condenser, an expansion device, and an evaporator in fluid communication with the first fluid circuit;

a plurality of sensors associated with the freezer and the refrigeration system for measuring operating characteristics in and around the freezer;

a controller operatively coupled to the refrigeration system, the controller being configured to operate the freezer as follows:

operate the refrigeration system to provide cooling to the cabinet via the evaporator during periodic operational cycles of the compressor;

monitor a time elapsed since a most recent defrost cycle of the evaporator was performed or since a startup of the freezer, if there has not been a most recent defrost cycle of the evaporator;

determine whether the time elapsed is greater than a current defrost interval;

perform a defrost cycle of the evaporator in response to determining that the time elapsed is greater than the current defrost interval;

vary the current defrost interval between at least a first, larger predetermined time value and a second, smaller predetermined time value based on a plurality of trigger signals that are each generated by at least one of the plurality of sensors associated with the refrigeration system and the freezer in response to various operating characteristics of the freezer; and independent of a total duration of the defrost cycle, automatically reset the current defrost interval to the first, larger time value after completion of the defrost cycle unless a continuous run time of the compressor as determined by a first timer is equal to or exceeds a runtime threshold during the defrost cycle or a defrost drip time as determined by a second timer is equal to or exceeds a drip time threshold during the defrost cycle which results in the current defrost interval being set to the second, smaller predetermined time value.

10. The freezer of claim 9, wherein when one or more of the plurality of trigger signals is generated to cause variation of the current defrost interval, the controller is configured to operate the freezer with the additional following steps:

determine whether the time elapsed since the most recent defrost cycle is greater than or equal to the second, smaller time value;

if the time elapsed is greater than or equal to the second, smaller time value, schedule a defrost cycle for the evaporator to be performed after the end of a current periodic operational cycle; and if the time elapsed is less than the second, smaller time value, proceed with the step of varying the current defrost interval to set it to the second, smaller time value.

11. The freezer of claim 9, wherein the plurality of sensors associated with the freezer and the refrigeration system further comprises:

a door open sensor configured to determine when the door into the cabinet is opened and for how long the door is opened;

an ambient temperature sensor positioned to measure an ambient temperature outside of the cabinet;

a defrost sensor positioned to measure a defrost temperature at the evaporator; and a compressor sensor tracking operational run times of the compressor.

12. The freezer of claim 11, wherein the plurality of trigger signals that are generated to prompt the varying of the current defrost interval is selected to be indicative of one or more of the following operating characteristics:

(i) an accumulated open time of the door of the freezer between defrost cycles exceeding a first time threshold;

(ii) the ambient temperature exceeding a first temperature threshold for a predetermined amount of time;

(iii) an operational failure of the ambient temperature sensor;

(iv) the defrost temperature being less than or equal to a second temperature threshold for a predetermined amount of time;

(v) an operational failure of the defrost sensor;

(vi) a continuous run time of a compressor of the refrigeration system exceeding a second time threshold during the periodic operational cycles;

(vii) a continuous run time of the compressor exceeding a third time threshold during a defrost cycle; and (viii) a defrost drip time exceeding or being equal to a fourth time threshold.

13. The freezer of claim 12, wherein one of the plurality of trigger signals is generated in response to each of the operating characteristics (i)-(viii), thereby causing the controller to vary the current defrost interval in response to any of these operating characteristics being determined at the freezer.

14. The freezer of claim 9, wherein upon the startup of the freezer, the controller is configured to operate the freezer with the additional following steps:

determine if the startup is an initial startup or a startup from a power loss condition;

if the startup is an initial startup, set the current defrost interval to be equal to the second, smaller time value; and if the startup is from a power loss condition, set the current defrost interval to be equal to a third time value that is even smaller than the second, smaller time value.

15. The freezer of claim 9, wherein during the step of performing the defrost cycle, the controller is configured to operate the freezer as follows:

vary a speed of the compressor to optimize efficiency during the defrost cycle.

16. The method of claim 1, wherein the step of performing the defrost cycle further comprises:

varying a speed of a compressor of the refrigeration system to optimize efficiency during the defrost cycle.

17. A method of operating a freezer which includes a cabinet and a refrigeration system including an evaporator and a compressor, the method comprising:

operating the refrigeration system to provide cooling to the cabinet during periodic operational cycles of the compressor;

monitoring a time elapsed since a most recent defrost cycle of the evaporator was performed or since a startup of the freezer, if there has not been a most recent defrost cycle of the evaporator;

determining whether the time elapsed is greater than a current defrost interval;

performing a defrost cycle of the evaporator in response to determining that the time elapsed is greater than the current defrost interval;

varying the current defrost interval between at least a first, larger time value and a second, smaller time value based on a plurality of trigger signals that are each generated by at least one of a plurality of sensors associated with the refrigeration system and the freezer in response to various operating characteristics of the freezer;

determining whether the time elapsed since the most recent defrost cycle is greater than or equal to the second, smaller time value when one or more of the plurality of trigger signals is generated to cause variation of the current defrost interval;

if the time elapsed is greater than or equal to the second, smaller time value, scheduling a defrost cycle for the evaporator to be performed after the end of a current periodic operational cycle;

if the time elapsed is less than the second, smaller time value, proceeding with the step of varying the current defrost interval to set it to the second, smaller time value; and independent of a total duration of the defrost cycle, automatically resetting the current defrost interval to the first, larger time value after completion of the defrost cycle unless a continuous run time of the compressor is equal to or exceeds a runtime threshold during the defrost cycle or a defrost drip time is equal to or exceeds a drip time threshold during the defrost cycle which results in setting the current defrost interval to the second, smaller predetermined time value.

18. The method of claim 17, wherein the plurality of trigger signals that are generated to prompt the varying of the current defrost interval is selected to be indicative of one or more of the following operating characteristics:

(i) an accumulated open time of a door providing access into the cabinet of the freezer between defrost cycles exceeding a first time threshold;

(ii) an ambient temperature outside of the freezer exceeding a first temperature threshold for a predetermined amount of time;

(iii) an operational failure of an ambient temperature sensor configured to measure the ambient temperature;

(iv) a defrost temperature measured at the evaporator being less than or equal to a second temperature threshold for a predetermined amount of time;

(v) an operational failure of a defrost sensor configured to measure the defrost temperature;

(vi) a continuous run time of a compressor of the refrigeration system exceeding a second time threshold during the periodic operational cycles;

(vii) a continuous run time of the compressor exceeding a third time threshold during a defrost cycle; and (viii) a defrost drip time exceeding or being equal to a fourth time threshold.

19. The method of claim 17, wherein the step of performing the defrost cycle further comprises:

varying a speed of a compressor of the refrigeration system to optimize efficiency during the defrost cycle.

20. A freezer, comprising:

a cabinet having an interior and a door providing access into the interior;

a refrigeration system for cooling the cabinet and defining a fluid circuit for circulating a refrigerant, the refrigeration system having a compressor, a condenser, an expansion device, and an evaporator in fluid communication with the first fluid circuit;

a plurality of sensors associated with the freezer and the refrigeration system for measuring operating characteristics in and around the freezer;

a controller operatively coupled to the refrigeration system, the controller being configured to operate the freezer as follows:

operate the refrigeration system to provide cooling to the cabinet via the evaporator during periodic operational cycles of the compressor;

monitor a time elapsed since a most recent defrost cycle of the evaporator was performed or since a startup of the freezer, if there has not been a most recent defrost cycle of the evaporator;

determine whether the time elapsed is greater than a current defrost interval;

perform a defrost cycle of the evaporator in response to determining that the time elapsed is greater than the current defrost interval;

vary the current defrost interval between at least a first, larger time value and a second, smaller time value based on a plurality of trigger signals that are each generated by at least one of the plurality of sensors associated with the refrigeration system and the freezer in response to various operating characteristics of the freezer;

determine whether the time elapsed since the most recent defrost cycle is greater than or equal to the second, smaller time value when one or more of the plurality of trigger signals is generated to cause variation of the current defrost interval;

if the time elapsed is greater than or equal to the second, smaller time value, schedule a defrost cycle for the evaporator to be performed after the end of a current periodic operational cycle;

if the time elapsed is less than the second, smaller time value, proceed with the step of varying the current defrost interval to set it to the second, smaller time value; and independent of a total duration of the defrost cycle, automatically reset the current defrost interval to the first, larger time value after completion of the defrost cycle unless a continuous run time of the compressor as determined by a first timer is equal to or exceeds a runtime threshold during the defrost cycle or a defrost drip time as determined by a second timer is equal to or exceeds a drip time threshold during the defrost cycle which results in the current defrost interval being set to the second, smaller predetermined time value.

21. The freezer of claim 20, wherein the plurality of trigger signals that are generated to prompt the varying of the current defrost interval is selected to be indicative of one or more of the following operating characteristics:

(i) an accumulated open time of the door of the freezer between defrost cycles exceeding a first time threshold;

(ii) the ambient temperature exceeding a first temperature threshold for a predetermined amount of time;

(iii) an operational failure of the ambient temperature sensor;

(iv) the defrost temperature being less than or equal to a second temperature threshold for a predetermined amount of time;

(v) an operational failure of the defrost sensor;

(vi) a continuous run time of a compressor of the refrigeration system exceeding a second time threshold during the periodic operational cycles;

(vii) a continuous run time of the compressor exceeding a third time threshold during a defrost cycle; and (viii) a defrost drip time exceeding or being equal to a fourth time threshold.

* * * * *